US005350235A

United States Patent [19]

Hagen et al.

[11] Patent Number: 5,350,235

[45] Date of Patent: Sep. 27, 1994

[54] IN LINE DYNAMIC MIXER WITH FOLDING ELEMENTS AND PERFORATED PLATES

[75] Inventors: Peter Hagen; Matthias Hagen, both of Harbor Springs, Mich.

[73] Assignee: Sealex, Inc., Harbor Springs, Mich.

[21] Appl. No.: 184,630

[22] Filed: Jan. 21, 1994

[51] Int. Cl.[5] ..... B01F 7/04

[52] U.S. Cl. ..... 366/168; 366/290; 366/293

[58] Field of Search ..... 366/76, 77, 78, 79, 366/80, 83, 87, 90, 96, 97, 98, 99, 241, 279, 290, 292, 293, 302, 307, 14, 15, 167, 168; 425/207, 208, 209

[56] References Cited

U.S. PATENT DOCUMENTS

| | | | |
|---|---|---|---|
| 4,260,264 | 4/1981 | Maki | 366/76 |
| 4,334,785 | 6/1982 | Blach | 366/322 |
| 4,640,672 | 2/1987 | Ellwood | 425/208 |
| 4,802,769 | 2/1989 | Tanaka | 425/209 |
| 4,871,259 | 10/1989 | Harada | 425/209 |
| 5,129,729 | 7/1992 | Geyer | 366/90 |

*Primary Examiner*—Robert W. Jenkins
*Attorney, Agent, or Firm*—Roger H. Borrousch

[57] ABSTRACT

Materials of varying viscosity can be homogeneously mixed continuously by using an in-line dynamic mixer which rapidly moves the materials interchangeably from a dynamic inner rotating means to a stationary chamber wall with additional mixing provided by stationary posts and perforated bulkheads.

4 Claims, 1 Drawing Sheet

IN LINE DYNAMIC MIXER WITH FOLDING ELEMENTS AND PERFORATED PLATES

BACKGROUND OF THE INVENTION

1. Field of the Invention

This invention relates to dynamic mixers which are especially useful for continuous mixing operations.

2. Background Information

Improved equipment for mixing of materials of widely different viscosities to provide a homogeneous product is always in demand. Today much of the equipment for mixing materials of different viscosities is either batch type equipment and/or static type mixers. Batch mixing equipment has the obvious disadvantage that it is slow, often leads to high waste rates, and often expensive because of the labor costs. Static mixing equipment usually requires high shear conditions when highly viscous materials are mixed because the material is forced through the mixer and high shear can damage the material being mixed or increase the temperature above desirable ranges. Static mixers often require high pressures with the pressure differencial from input to output increasing with longer mixers or multiple mixers.

A diligent search was conducted to find a mixer which would allow a continuous mixing operation and produce a product which was homogeneous over the entire production as long as the feeds were constant. The applicants have now discovered such a mixer.

SUMMARY OF THE INVENTION

An object of this invention is to provide in-line mixer elements which rapidly move materials of different viscosities interchangeably from a dynamic inner rotating means to a stationary chamber (stator) wall with additional mixing provided by stationary posts and perforated plates (bulkheads).

This invention relates to a mixing apparatus comprising a plurality of disconnectable mixing units, each said mixing unit having a casing with a chamber extending the length of said casing; a perforated bulkhead, removably disposed within the chamber of said casing, said perforated bulkhead having a spindle bushing disposed therein; and a spindle in coaxial relation to said chamber and rotatably mounted in said spindle bushing, said spindle having means for mixing and means for disconnectably coupling the spindle of an adjacent mixing unit, so that upon rotation of one spindle, the spindle in each mixing unit rotates, and material within the chamber of each said mixing unit is mixed.

BRIEF DESCRIPTION OF THE DRAWINGS

Description of the Figures

Figures 1, 2, 3, 4:
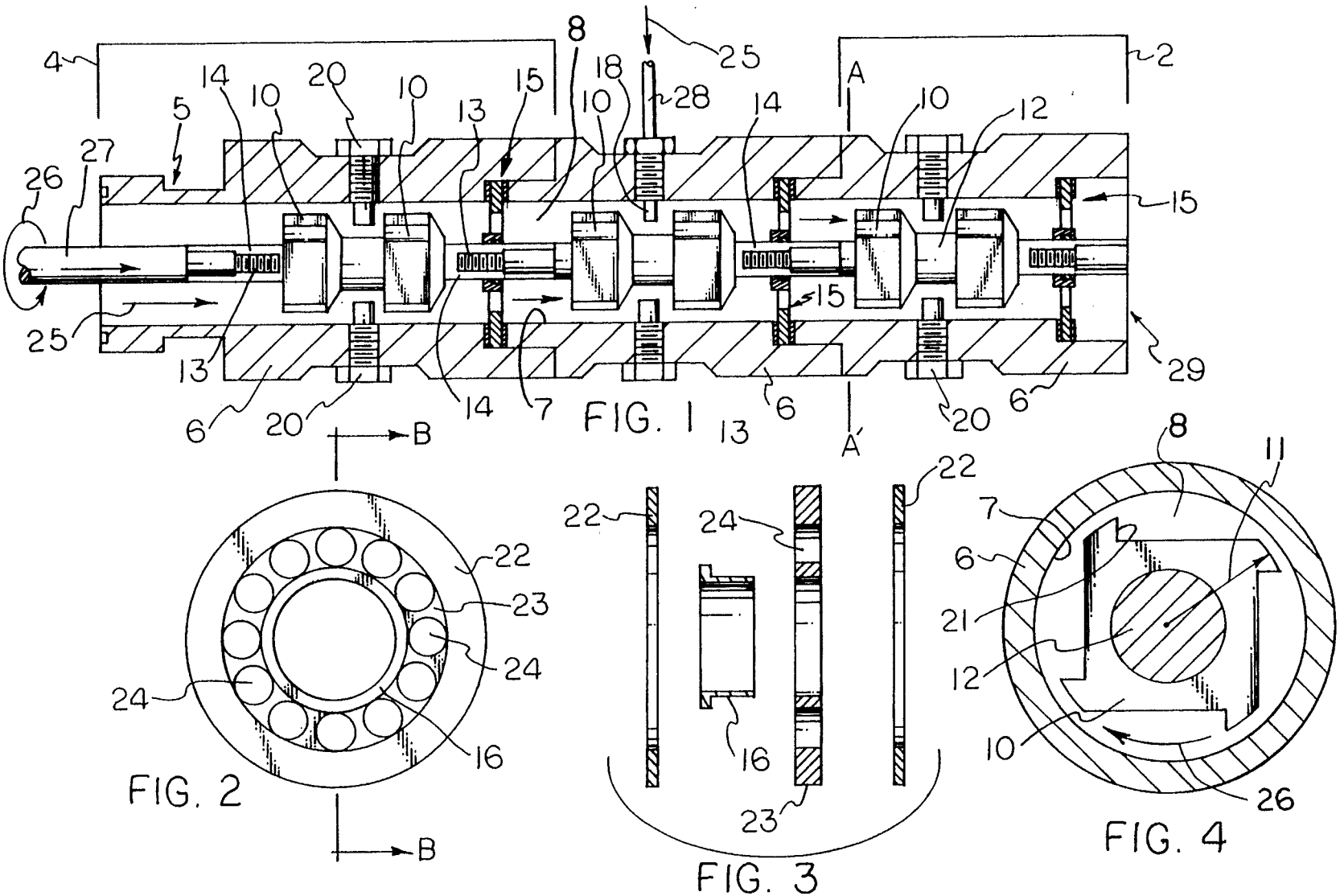

FIG. 1 is a partial cross section of two connected disconnectable mixing units and an end disconnectable mixing unit.

FIG. 2 is an end view of a bulkhead assembly.

FIG. 3 is an exploded cross section of the bulkhead assembly of FIG. 2 at B–B'.

FIG. 4 is a cross section at A–A' of a disconnectable mixing unit showing the flywheel configuration.

List of Reference Numbers and Description

2—disconnectable mixing unit
4—end disconnectable mixing unit
5—connection flange
6—casing
7—chamber wall
8—chamber
10—flywheel
12—spindle
13—male threaded spindle fastener
14—female threaded spindle fastener
15—bulkhead assembly
16—spindle bushing
18—inlet port
20—post
21—folding recess
22—washer
23—bulkhead
24—bulkhead perforation
25—direction of material flow
26—rotational direction of spindle
27—spindle driver
28—feed line
29—material exit end

DESCRIPTION OF THE PREFERRED EMBODIMENTS

The dynamic in-line mixer of this invention is made up of disconnectable mixing units as shown by FIG. 1, a partial cross section of two connected disconnectable mixing units and an end disconnectable mixing unit where 2 illustrates one such unit. Each disconnectable mixing unit comprises a casing 6 containing a chamber 8 and a chamber wall 7. The chamber is tubular in nature and its size is such that it can be connected with other disconnectable mixing units including an end disconnectable mixing unit 4 which varies from the other disconnectable mixing units in that it has a connection flange 5 for attachment to an inlet for one material to be mixed and a spindle driver 27.

In each disconnectable mixing unit, there is a spindle 12 which can be removably connected through male threaded spindle fasteners 13 to female threaded spindle fasteners 14 of another disconnectable mixing unit. Each disconnectable mixing unit has mixing means which are flywheels 10. There are at least two flywheels per disconnectable mixing unit. Each flywheel is spaced from the next flywheel along the spindle to provide an area in which there is at least one mounted post 20 which protrude into the chamber between the flywheels. There can be one or more such post between each pair of flywheels. The posts 20 are mounted to protrude into chamber 8 from chamber wall 7. For example, there may be four posts spaced approximately equidistance from each other around the casing and protruding into the chamber between a pair of flywheels. It is preferred to have at least four such posts between each pair of flywheels. These posts 20 may be attached to the casing by threaded means or may be welded into place or whatever other means is suitable. Using posts which are attached by threaded means allows each post to potentially become a feed line for adding other materials. This allows flexibility by interchanging a post for a feed line with an inlet port 18 as illustrated in FIG. 1. Each disconnectable mixing unit also contains a bulkhead assembly 15. This bulkhead increases the mixing operation and provides a homogeneous product exiting material exit end 29 throughout the continuous operation of this in-line dynamic mixer.

The bulkhead assembly 15 is shown in more detail from the end view in FIG. 2 and from the exploded cross section in FIG. 3. The bulkhead assembly is made up of a bulkhead 23 which contains bulkhead perforations 24. The number and size of perforations should be sufficient to allow the material to flow at an acceptable rate without being obstructive to the flow and without causing the shear to increase to an undesirable point. The bulkhead 23 is essentially stationary and is mounted such that a spindle bushing 16 is between bulkhead 23 and spindle 12. The spindle bushing allows the spindle to rotate while the bulkhead remains stationary. The bulkhead 23 is held in place essentially perpendicular to the spindle axis by washers 22.

The flywheel 10 is illustrated in FIG. 4 as the cross section at A–A′ of a disconnectable mixing unit in FIG. 1. As shown, the flywheel has a folding recess 21 which can be the squared shape as shown or other shapes which can be curved instead of squared. This folding recess turns the material in a folding manner into the space between two flywheels where the post also cause a mixing action to take place. As the material flows through the chamber in direction 25, the spindle rotates, such as shown by 26. As the spindle rotates, the flywheels also rotate. At least one point on the flywheel at the longest radius from the spindle center, describes a rotational circumference which is in spaced relationship with the chamber wall such that the material flows through the chamber without high shear and in a continuous manner. The shape of the flywheel and the nature of the folding recess facilitates the cleaning operations of the mixer.

This in-line dynamic mixer is especially useful for mixing a viscous material entering through the end disconnectable mixer unit and a low viscosity fluid material entering through an inlet port from a feed line in one of the disconnectable mixer units. This mixer is readily varied to allow for many disconnectable mixer units such that many kinds of materials can be added along the length of this in-line dynamic mixer. This mixer can be used to pigment products, to introduce additives, and to add curing agents. A feature of this mixer is that it is useful for continuous operation in the production of homogeneous product exuding from the material exit end 29.

While this invention is described in connection with a preferred embodiment, it is to be understood that it is not intended to limit the invention to that embodiment. On the contrary, it is intended to cover all alternatives, modifications, and equivalents as may be included within the spirit and scope of the invention as defined by the appended claims.

That which is claimed is:

1. A mixing apparatus comprising a plurality of disconnectable mixing units, each said mixing unit having a casing with a chamber extending the length of said casing;

a perforated bulkhead, removably disposed within the chamber of said casing, said perforated bulkhead having a spindle bushing disposed therein; and a spindle in coaxial relation to said chamber and rotatably mounted in said spindle bushing, said spindle having means for mixing and means for disconnectably coupling the spindle of an adjacent mixing unit, so that upon rotation of one spindle, the spindle in each mixing unit rotates, and material within the chamber of each said mixing unit is mixed.

2. The mixing apparatus in accordance with claim 1 wherein said means for mixing comprises at least two flywheels, each flywheel having a substantially rounded configuration with folding recesses, said flywheels having a rotational circumference described by the longest flywheel radius which is in spaced relationship with the chamber wall.

3. The mixing apparatus in accordance with claim 2 wherein said casing has at least one post mounted to protrude into said chamber from said chamber wall.

4. The mixing apparatus in accordance with claim 3 wherein at least one post is replaced with an inlet port extending to an outer region of said casing to form a feed line.

* * * * *